US006047867A

United States Patent [19]

Heiber

[11] Patent Number: 6,047,867

[45] Date of Patent: Apr. 11, 2000

[54] GARMENT HANGER

[76] Inventor: Arnold Heiber, P.O. Box 8731, Horseshoe Bay, Tex. 78657-8731

[21] Appl. No.: 09/060,572

[22] Filed: Apr. 15, 1998

[51] Int. Cl.[7] ..... A47G 25/48

[52] U.S. Cl. ..... 223/96; 223/95; 223/85

[58] Field of Search ..... 223/85, 95, 96, 223/93, 91, 88; 211/113

[56] References Cited

U.S. PATENT DOCUMENTS

| | | | |
|---|---|---|---|
| 2,017,944 | 10/1935 | Braley | 223/85 |
| 2,123,518 | 7/1938 | Yankovitch | 223/93 |
| 2,318,770 | 5/1943 | Freeman | 223/93 |
| 3,343,734 | 9/1967 | Merriman | 223/95 |
| 3,409,191 | 11/1968 | Fuss | 223/93 |
| 3,411,680 | 11/1968 | Lundeen | 223/96 |
| 5,361,949 | 11/1994 | Petrou | 223/96 |
| 5,562,237 | 10/1996 | Saliaris | 223/96 |
| 5,613,628 | 3/1997 | Burkhalter | 223/85 |

*Primary Examiner*—Bibhu Mohanty
*Attorney, Agent, or Firm*—Wall Marjama Bilinski & Burr

[57] ABSTRACT

A garment hanger including an elongate slide member adapted to receive a garment suspended therefrom, and clamp means for holding the garment on the elongate slide member. The elongate slide member has a first end region and an opposed second end region, and is structured so as to impart a gravitational bias on the garment in the direction of the second end region. The clamp means is arranged proximate the first end region of the elongate slide member, and holds the garment on the elongate slide member in opposition to the gravitational bias imposed on the garment by the structure of the slide member. The hanger also includes support means for associating the garment hanger with a fixed support structure, such as a clothes rod.

20 Claims, 2 Drawing Sheets

GARMENT HANGER

FIELD OF THE INVENTION

The present invention relates to a new and improved garment hanger and, in particular, to a garment hanger for trousers or slacks having creased edges.

BACKGROUND OF THE INVENTION

Various different types of hangers have been developed over the years to hang various different types of garments. For example, creased slacks typically are hung by aligning the crease in each leg of the slacks and then clamping horizontally opposed ends of either the waist or cuff to a hanger body. Alternatively, the slacks are draped over the horizontal rod portion of the hanger, with the creased edges of the slacks aligned on both sides, and then clamped by some means to maintain the position of the slacks with respect to the horizontal rod. In both cases, however, it is often difficult and cumbersome to maintain alignment of the creases of the slacks and operate the clamping mechanism at the same time. It is even more difficult, in these types of prior art hangers, to place the garment on the hanger or remove the garment from the hanger while the hanger is suspended from a clothes rod in a closet or on a store rack.

In some common prior art hanger designs, the clamps used to hold the garment in place on the hanger must exert a sufficient clamping force in order to support the entire weight of the garment. As a result, the clamps often times have to be manufactured apart from the hanger itself, and then later assembled to the hanger. Additionally, in many designs the clamps operate transversely to the plane of the hanger, thus increasing the width of the overall hanger structure. Such increased width in turn increases the space required for packaging, shipping and closet storage.

For the reasons explained above, prior art hangers designed to hold creased garments tend to be bulky, difficult to use and costly to produce.

SUMMARY OF THE INVENTION

It is an object of the present invention to provide a garment hanger particularly suited for hanging trousers, slacks and similar creased garments, either separately or together with a jacket, that is simple in structure, easy to use, and easy and cheap to manufacture. The structure of the hanger of the present invention makes the hanging of creased garments a quick and easy chore, particularly where alignment of the garment for the maintenance of creases is desired, regardless of whether the hanger is suspended from a fixed support structure at the time or held in the hands prior to being placed on the fixed support structure (e.g., a clothes rod).

In accordance with one preferred embodiment of the present invention, a garment hanger is provided that includes an elongate slide member adapted to receive a garment suspended therefrom, and clamp means for holding the garment on the elongate slide member. The elongate slide member has a first end region and an opposed second end region, and is structured so as to impart a gravitational bias on the garment in the direction of the second end region. The clamp means is arranged proximate the first end region of the elongate slide member, and holds the garment on the elongate slide member in opposition to the gravitational bias imposed on the garment by the structure of the slide member. The hanger also includes support means for associating the garment hanger with a fixed support structure, such as a clothes rod.

The structure of the hanger described above provides simple means for assuring that the garment will remain aligned and stretched out (under the influence of gravity) to maintain its shape, even when subject to accidental movement from accessing nearby garments.

In a preferred embodiment of the present invention, the hanger is manufactured from plastic in a single injection molding operation, and the clamp means is disposed in the same plane as the slide member and support means. These features of the present invention make the most economical use of materials and time in the manufacture of the hanger, as there are no separate parts to assemble. Additionally, by arranging all of the component parts of the hanger in the same plane, a simpler and less costly mold can be used for molding the hanger. This latter feature also minimizes the space required for packaging, shipping and closet storage.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
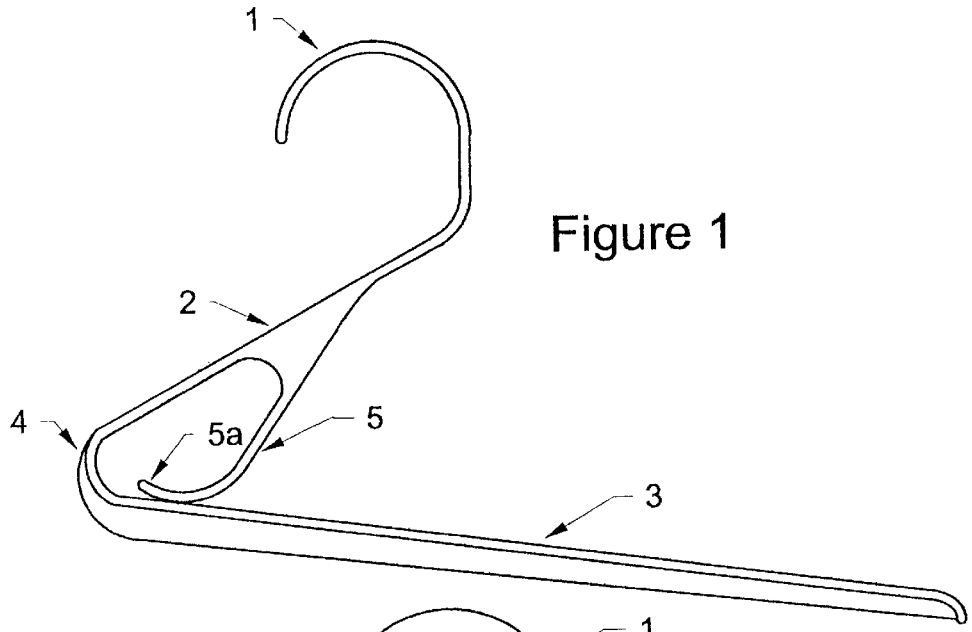
FIG. 1 shows one embodiment of a hanger according to the present invention with an inclined support member for slacks or trousers as it would be configured without the additional support elements required for hanging a jacket over the slacks.

The clothes hanger shown in FIG. 1 includes a hook 1 for suspending the hanger from a fixed support structure, such as a clothes rod. Other suspension means could be used, such as the interlocking ball and socket assembly often seen in hotels. Both of these types of structures are considered to be hooks, in the broadest sense of the term as used herein. The hanger includes an inclined extension arm 2, much like a standard clothes hanger, but the second extension arm often seen in a standard clothes hanger is omitted. This provides a broad opening to the right of hook 1 that allows easy placement of garments on the hanger. This also lends itself to more efficient display of the garment on store racks in that it reduces unnecessary handling and removal of the garment from the hanger.

The extension arm 2 is joined to an inclined support member 3 at a junction elbow 4. A clamp 5 extends from extension arm 2 and freely engages an upper surface of support member 3, or is spaced therefrom a distance less than the thickness of the garment to be suspended from the hanger. The terminal end 5*a* of clamp 5 is flared upwardly away from support member 3 to assist in removing a garment from the hanger.

Support member 3 is slightly inclined with respect to horizontal so as to act effectively as a slide for any garment hung therefrom. A garment would be folded over inclined support member 3, and a gravitational bias would be imposed on the garment by the inclination of support member 3. The garment would be restrained from sliding entirely down support member 3 by action of clamp 5 positioned at the upper end thereof. In the case of a creased garment, clamp 5 would hold one pair of the creased edges of the garment together at the upper end of inclined support member 3. When the hanger is suspended on a fixed support via hook 1, the effect of gravity will keep the garment stretched out along support member 3. This in turn will maintain the alignment of the other, unrestrained creased edges of the garment, and will maintain the angle of inclination of the support member 3.

The angle of inclination of support member 3 must be large enough such that gravity will cause the remaining, unclamped portion of the fabric of the garment, below clamp 5, to remain stretched out along support member 3 and maintain the alignment of the garment. The angle of inclination must not be too large, however, or else the fabric will drape into folds.

At least the main portion of support member 3 from which the garment is suspended has a surface roughness low enough to allow the garment to slide freely along the support member. It is possible to roughen the surface of support member 3 immediately below clamp 5 in order to increase the clamping effect imposed on the garment by clamp 5. This specific arrangement would facilitate the fabric sliding down and stretching out across inclined support member 3 under the influence of gravity, while maintaining sufficient gripping force between clamp 5 and support member 3.

Preferably, the orientation of clamp 5 is selected to cause a wedge effect when a garment is positioned between clamp 5 and support member 3. As shown in FIG. 1, clamp 5 projects downwardly in a direction opposite to the extension of support member 3, such that the gravitational force acting on the garment by the inclination of support member 3 will cause clamp 5 to tighten against the support member.

The physical design of the hanger together with the suspension point and the center of gravity of the garment will determine, in the manner of a pendulum, the angle of inclination of support member 3 at rest, which is the angle to which it will return if disturbed. If the garment is accidentally disturbed, it will slide down the inclined supporting member and return to its original position under the influence of gravity.

To hang a pair of creased trousers on the hanger shown in FIG. 1, one need only align the creases in the trousers, grasp the trousers between two fingers at the point at which the trousers are to be draped over inclined support member 3, and then slide that portion of the trousers up inclined support member 3 into engagement with clamp 5. Once the hanger is suspended, the force of gravity will cause the garment to slide down support member 3, but clamp 5 will tighten and hold the garment on support member 3 until it is intentionally released.

The clamp 5 may be formed integrally with the hanger as shown in FIG. 1, or may be a separate clamping element, if desired. In the case of an integral clamp, the entire hanger could be injection molded from plastic or other suitable material in a single step. In this case, the clamp, being made of plastic, would exhibit sufficient spring characteristics to insure the retention of a garment placed between clamp 5 and support member 3. Additionally, since clamp 5 is formed in the same plane as the remainder of the hanger and need not exceed the width of the remainder of the hanger structure, the overall thickness of the hanger can be reduced.

The length of support member 3 need not extend the full width of the garment to be suspended therefrom, since the stiffness of most fabrics used in making trousers and slacks should be sufficient to maintain the folded shape of the garment. As a result, less material is needed to manufacture the hanger shown in FIG. 1.

Although not shown in the drawings, it is possible to add another extension arm to connect the free end of support member 3 to the base of hook 1 to provide added support for the garment. Such an extension arm would, of course, be longer than extension arm 2 so as to maintain the inclined orientation of support member 3.

Figure 2:
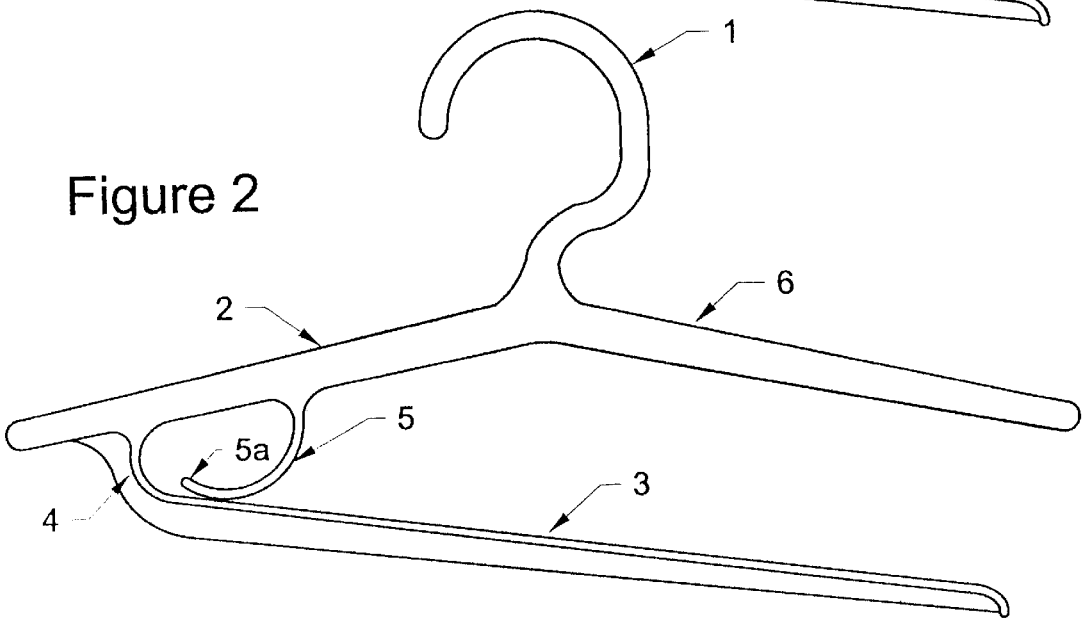
FIG. 2 shows another embodiment of a hanger similar to that shown in FIG. 1, with additional support elements for hanging a jacket over the slacks.
Figure 3:
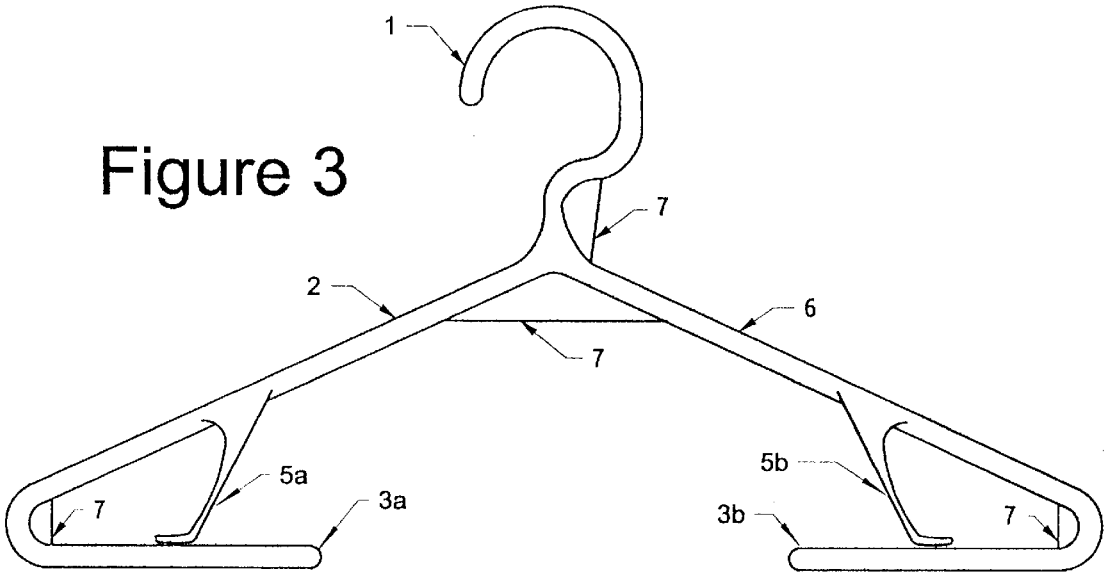
FIG. 3 shows another embodiment of a hanger of the present invention in which slacks or similar garments may be folded over two opposed, separated, cantilevered support members, which may be horizontal or slightly inclined, and clamped to retain the garment in tension between the opposed, cantilevered support members to preserve the alignment of the garment and prevent the garment from falling through the space between the opposed, cantilevered support members.

FIG. 2 shows another embodiment of a hanger in accordance with the present invention, wherein a second arm extension 6 is added to the hanger to accommodate hanging a jacket by supporting the shoulders of the jacket in the traditional manner. The difference again, however, is the use of an inclined support member/slide for hanging the slacks or trousers that match the jacket. As explained above, it is the inclination to horizontal of support member 3 that makes it possible to use a single clamp 5 to retain and hold in alignment one pair of creases at the upper end of the support member, and make use of the force of gravity to maintain alignment of the garment and keep the garment stretched out even if the garment is accidentally disturbed. As with the case of FIG. 1, it is possible to connect the free end of support member 3 to extension arm 6 to provide added support for the garment. In this case, however, an additional substantially vertical extension piece would be interposed between the free ends of support member 3 and extension arm 6 to maintain the orientation of both support member 3 and extension arm 6 as depicted in FIG. 2 FIG. 3 shows another embodiment of a hanger of the present invention wherein two clamps 5*a,* 5*b* and opposed, cantilevered support members 3*a*, 3*b* are utilized in a configuration that is more in keeping with the design of traditional hangers. This design facilitates the hanging of trousers without having to thread the trousers through the hanger as in many similar hanger designs of the prior art. This embodiment can also be made by a single injection molding operation without assembly of parts and with efficient use of materials. Like the hangers shown in FIGS. 1 and 2, the clamping force required is minimal and the clamping action can be within the plane of the hanger, conserving space and reducing the cost of manufacture. Web-like reinforcing members 7 can be employed to increase the overall strength of the hanger.

Although support members 3*a*, 3*b* are arranged horizontally, the opening therebetween allows the force of gravity to operate on the garment suspended from the hanger. More specifically, a gravitational bias will be imposed on the center of the garment, which is not supported by support members 3*a,* 3*b,* and this gravitational bias will operate to keep the garment in its original stretched out, aligned position, in the same manner as described above with respect to FIGS. 1 and 2. The surface roughness of the support members is the same as that described above with respect to FIGS. 1 and 2.

The folded garment suspended from the hanger will appear as if supported across its entire width even through a substantial space exists between the opposed support members 3*a,* 3*b,* because the garment is held in tension between the opposed clamps 5*a,* 5*b.* The space between the support members 3*a*, 3*b* facilitates placement and removal of the garment on and from the hanger.

In the preferred embodiments described herein, clamp 5 will secure the garment to the upper edge of support member 3, over which the garment is folded, and will operate, to clamp or release the garment, within the plane of the hanger. This arrangement minimizes the width of the hanger and also lends itself to ease of manufacture as a single piece injection molding. Obviously, transverse means of clamping the garment will also be effective, but will not minimize the width of the hanger.

Additionally, in the preferred embodiments of the hanger of the present invention, the weight of the folded garment is largely supported by the structural supporting member or members over which it is folded, and not solely by the clamp or clamps as in most prior art hangers. As a result, the clamping force necessary to retain the garment in the desired alignment can be minimized. Additionally, since clamp 5 needs to be made no wider than the width of remaining structural members of the hanger, there is an economy of space for packaging as well as during use in closets or on store racks.

While the present invention has been particularly shown and described with reference to the preferred mode as illustrated in the drawing, it will be understood by one skilled in the art that various changes in detail may be effected therein without departing from the spirit and scope of the invention as defined by the claims. For example, while the embodiment shown in FIG. 1 includes a hook for suspending the hanger from a clothes rod or the like, it is possible to dispose of hook 1 and the portion of extension arm 2 that extends above clamp 5, and simply fasten the hanger to a wall in the region of junction elbow 4. An array of such hangers could be permanently mounted on a closet wall to receive a wardrobe of trousers or slacks. Additionally, each hanger could be fastened in a manner that would allow the hanger to pivot in a horizontal plane. The hangers could then be extended perpendicular to the wall for access and pushed flat against the wall for more efficient storage.

I claim:

1. A garment hanger, comprising:

an elongate slide member adapted to receive a garment suspended therefrom, said elongate slide member having a first end region and an opposed second end region, and being structured so as to impart a gravitational bias on the garment in the direction of said second end region;

clamp means, arranged proximate said first end region of said elongate slide member, for holding the garment on said elongate slide member in opposition to the gravitational bias; and support means for associating the garment hanger with a fixed support structure.

2. The garment hanger according to claim 1, wherein said elongate slide member, said clamp means, and said support means are all arranged in substantially the same plane.

3. The garment hanger according to claim 1, wherein the surface roughness of said first end region of said elongate slide member is greater than the surface roughness of said second end region of said elongate slide member.

4. The garment hanger according to claim 1, wherein the fixed support structure is a vertical wall, and said elongate slide member is connected to the vertical wall via said support means and extends outwardly and downwardly therefrom.

5. The garment hanger according to claim 1, wherein the fixed support structure is a clothes rod, and said elongate slide member is supported by the rod via said support means, and, when so supported, said elongate slide member is inclined downwardly, with respect to a horizontal plane, in a direction extending from said first end region toward said second end region.

6. The garment hanger according to claim 1, wherein said clamp means is arranged proximate only said first end region.

7. The garment hanger according to claim 1, wherein said clamp means includes a free end that extends along said elongate slide member in a direction generally away from said second end region.

8. The garment hanger according to claim 7, wherein said clamp means includes a main body portion, and an axial extension of said main body portion intersects said elongate slide member at an acute angle.

9. A garment hanger, comprising:

support means for supporting the garment hanger from a fixed support structure;

an elongate support member from which a garment is to be suspended, said elongate support member having a first end region and an opposed second end region, wherein, when the garment hanger is supported from the fixed support structure, said elongate support member is inclined downwardly, with respect to a horizontal plane, in a direction extending from said first end region toward said second end region to thereby impart a gravitational bias on the garment in the direction of said second end region; and clamp means, arranged proximate said first end region of said elongate support member, for holding the garment on said elongate support member in opposition to the gravitational bias.

10. The garment hanger of claim 9, wherein said support means, said elongate support member, and said clamp means are all arranged in the same plane.

11. The garment hanger of claim 9, wherein said support means comprises a hook, and the garment hanger further comprises a first arm member connecting said hook to said elongate support member at said first end region thereof.

12. The garment hanger of claim 11, wherein said clamp means comprises an integral extension of said first arm member.

13. The garment hanger of claim 10, wherein said hook, said first arm member, said elongate support member, and said clamp means are all arranged in the same plane.

14. The garment hanger of claim 9, wherein said support means comprises a hook, and the garment hanger further comprises a first arm member extending from said hook toward and connected to said first end region of said elongate support member, and a second arm member extending from said hook toward and spaced from said second end region of said elongate support member, wherein said elongate support member is adapted to support slacks or trousers, and said first and second arm members are adapted to support a jacket.

15. A garment hanger, comprising:

support means for supporting the garment hanger from a fixed support structure;

a first arm structure having a first end connected to said support means and a second end extending in a first direction downwardly from said support means;

a second arm structure having a first end connected to said support means and a second end extending in a second direction downwardly from said support means;

a first elongate support member having a first end connected to said second end of said first arm structure and a second end extending toward said second end of said second arm structure;

a second elongate support member having a first end connected to said second end of said second arm structure and a second end extending toward said second end of said first arm structure, wherein the second ends of said first and second elongate support members are in spaced opposition to one another;

first clamp means arranged proximate said first end of said first elongate support member;

second clamp means arranged proximate said first end of said second elongate support member;

wherein, when a garment is suspended from said first and second elongate support members, the spacing between said second ends of said first and second support members imparts a gravitational bias on the garment in the direction of said spacing, and said first and second clamp means hold the garment on said first and second elongate support members in opposition to the gravitational bias.

16. The garment hanger of claim 15, wherein said first and second elongate support members are arranged horizontally along a common axis.

17. The garment hanger of claim 15, wherein said first and second elongate support members are inclined with respect to a horizontal plane, from said first ends thereof toward said second ends thereof.

18. The garment hanger according to claim 15, wherein said first and second clamp means are arranged proximate only said first end region of said first and second elongate support members, respectively.

19. The garment hanger according to claim 15, wherein said first and second clamp means each has a free end that extends along said first and second elongate support members, respectively, in a direction generally away from said second end region of said first and second elongate support members, respectively.

20. The garment hanger according to claim 19, wherein said first and second clamp means each includes a main body portion, and an axial extension of said main body portion intersects said first and second elongate support members, respectively, at an acute angle.

* * * * *